US009512663B2

(12) United States Patent
Medawar

(10) Patent No.: US 9,512,663 B2
(45) Date of Patent: Dec. 6, 2016

(54) SECURITY DISPLAY CASE

(71) Applicant: Samuel C. Medawar, Lansing, MI (US)

(72) Inventor: Samuel C. Medawar, Lansing, MI (US)

( * ) Notice: Subject to any disclaimer, the term of this patent is extended or adjusted under 35 U.S.C. 154(b) by 0 days.

(21) Appl. No.: 14/966,092

(22) Filed: Dec. 11, 2015

(65) Prior Publication Data

US 2016/0168900 A1 Jun. 16, 2016

Related U.S. Application Data

(60) Provisional application No. 62/091,976, filed on Dec. 15, 2014.

(51) Int. Cl.

| | |
|---|---|
| ***E05G 1/02*** | (2006.01) |
| ***E05B 65/00*** | (2006.01) |
| ***E05G 1/04*** | (2006.01) |

(52) U.S. Cl.

CPC ..... *E05G 1/02* (2013.01); *E05B 65/0075* (2013.01); *E05G 1/04* (2013.01); *E05Y 2800/74* (2013.01)

(58) Field of Classification Search

CPC ..... E05B 65/0075; E05G 1/02; E05G 1/00; E05G 1/005; E05G 1/024; E05G 1/026; E05G 2700/02; E05G 1/04; B65D 25/22; Y10T 70/5031; E05Y 2800/74

USPC ..... 109/47

See application file for complete search history.

(56) References Cited

U.S. PATENT DOCUMENTS 636,445 A * 11/1899 McCabe ..... B66F 7/065 108/147
1,654,045 A * 12/1927 Howell ..... G07G 1/0027 109/47
1,778,857 A * 10/1930 James ..... E05B 47/0012 109/47
2,028,891 A * 1/1936 Bales ..... B21B 1/34 109/47
2,049,875 A * 8/1936 Singleton ..... E05G 5/006 109/47
3,216,776 A * 11/1965 Carbary ..... E05F 17/004 292/251.5
4,022,137 A * 5/1977 Chiu ..... E05G 1/10 109/44
4,625,658 A * 12/1986 Hodges ..... E05G 1/00 109/35
5,111,755 A * 5/1992 Rouse ..... A47B 81/005 109/25

(Continued)

FOREIGN PATENT DOCUMENTS

EP 0521728 A1 * 1/1993 ..... A47F 3/002

*Primary Examiner* — Suzanne Barrett
(74) *Attorney, Agent, or Firm* — The Weintraub Group, P.L.C.

(57) ABSTRACT

The present invention is a security display case comprising an enclosure defining a safe portion, a display housing with a lift platform and a closing member, the display housing moveable into and out of the safe portion, a lift mechanism disposed in the safe portion drivingly connected to the lift platform, the lift mechanism controlled by a first drive motor, a locking mechanism mounted atop the closure member comprising at least one latch finger adapted to extend into and retract out of the enclosure, the locking mechanism controlled by a second drive motor, and a control system controlling the first and second drive motors, the control system further comprising a lower limit switch, an upper limit switch, and a trip switch.

8 Claims, 9 Drawing Sheets

(56) References Cited

U.S. PATENT DOCUMENTS

| | | | | | |
|---|---|---|---|---|---|
| 5,179,901 | A * | 1/1993 | Adcock | E05G 1/06 | 109/45 |
| 5,273,352 | A * | 12/1993 | Saper | A47B 51/00 | 312/312 |
| 5,733,021 | A * | 3/1998 | O'Neill | A47F 3/002 | 312/114 |
| 7,428,873 | B1 * | 9/2008 | Searle | E05G 1/005 | 109/24 |
| 7,694,872 | B2 * | 4/2010 | Noll | G07F 9/06 | 109/47 |
| 8,117,973 | B1 * | 2/2012 | Frank | E05G 1/005 | 109/47 |
| 9,010,257 | B2 * | 4/2015 | McAlexander | E05G 1/02 | 109/47 |
| 9,078,531 | B1 * | 7/2015 | Medawar | A47F 3/002 | |
| 2006/0076860 | A1 * | 4/2006 | Hoss | A47B 51/00 | 312/312 |
| 2006/0102812 | A1 * | 5/2006 | Cvek | A47B 21/007 | 248/125.2 |
| 2007/0194674 | A1 * | 8/2007 | Salter | A47F 3/002 | 312/312 |
| 2008/0079337 | A1 * | 4/2008 | Vardaro | A47F 3/002 | 312/138.1 |
| 2008/0174215 | A1 * | 7/2008 | Amstutz | A47F 3/002 | 312/117 |
| 2009/0039743 | A1 * | 2/2009 | Gevaert | A47B 21/0073 | 312/223.2 |
| 2015/0252608 | A1 * | 9/2015 | Hall | E05G 1/00 | 109/47 |

* cited by examiner

SECURITY DISPLAY CASE

CROSS-REFERENCE TO RELATED APPLICATIONS

This application is a completion application of co-pending U.S. Patent Application Ser. No. 62/091,976, filed Dec. 15, 2014, for "Security Display Case," the entire disclosure of which is hereby incorporated by reference in its entirety including the drawing.

BACKGROUND OF THE INVENTION

1. Field of the Invention

The present invention relates to display cases which include a built-in storage safe. More particularly, the present invention relates to display cases which moves the display structure between a display position and a security, or storage safe position. Even more particularly, the present invention relates to such a display case which is either wall mounted, or seated on a floor.

2. Description of the Prior Art

Display cases are widely known for use in a variety of environments, including for displaying high-value articles such as jewelry, coins, watches, cameras, and the like. A typical display case has one or more glass windows and, thus, is particularly susceptible to theft when a criminal smashes the glass and removes as many valuable articles as possible before escaping.

Oftentimes, retailers will remove high-value items from their display cases at the close of business daily and relocate the merchandise into more secure storage. This routine transfer of goods between a display case and a security storage vault causes the problem of increased labor required to perform the relocation of display items at the end and beginning of a business day. Other problems include a possible wear and tear on the merchandise and display fixtures, and increases problems with inventory and loss control.

Accordingly, it would be of significant advantage to provide a security display case which would secure merchandise from possible theft without requiring the removal of the merchandise for safe storage after and between business hours. Further, secure in situ storage would protect the merchandise from fire after business hours.

Secure display cases are known, and typically include mechanisms for lowering a display shelf within a display case. These mechanisms oftentimes vary from motorized linear lifts to scissor jack lift assemblies. However, these devices are difficult to install in existing display cases or are difficult to use and/or unreliable over long term use. Further, some of the existing systems tend to operate very slowly and may not be effective in smash and grab daytime robberies.

Examples of apparatus related to security display cases are disclosed in Sands, EP 0521728A1, directed to a Security Receptacle, McCabe, U.S. Pat. No. 636,449 for a "Portable Elevator," and Salter, U.S. PAT Pub 2007/0194674 for "Lifting and Barrier Mechanism."

Another security display case is disclosed in U.S. Pat. No. 9,078,531 by Samuel C. Medawar, the Applicant herein, the disclosure of which is hereby incorporation by reference in its entirety, including the drawing. The display case shown therein includes a safe portion having a pair of panels pivotally connected thereto and adapted to be pivoted by a mechanism between open and closed positions, a display housing connected to the safe portion, and a scissors-like lift mechanism mounted in the safe portion for moving a lift platform supporting items to be displayed between lower secured storage and display positions.

The above publications are identified herein in recognition of a duty of disclosure of related subject matter, which may be relevant under 37 CFR 1.56, and specifically incorporated herein by reference as regards the conventional approaches and constructions taught therein.

Additionally, while each of the devices disclosed in the above prior published documents are believed to have been suitable for the uses and problems then intended to solve, there is an ongoing need for improvements in the design of security display cases, such as simpler and more compact designs and ease of operation.

Accordingly, it is to be appreciated that there is a need for improvements in security display cases, such as embodied in the invention herein.

SUMMARY OF THE INVENTION

The present invention is directed to a security display case for easily moving items on display, such as jewelry, guns, collectables, and like, between a safe position and a display position, when desired, and to secure the displayed items in the safe without having to transfer the merchandise to and from the display area after and before business hours.

The present invention, a security display case generally comprises: (a) an enclosure having an interior that defines a lower safe portion; and (b) a display housing having a lower lift platform and an upper end or closure member. The display housing is mounted in said safe portion for movement between a lowered or security or safe position, wherein the display housing is completely within the safe portion and the safe portion is securely sealed by the closure member, and a raised or display position permitting items on the lift platform to be viewed.

The display case includes a locking mechanism for locking the closure member of the display housing to the enclosure when the display housing is in the lowered or security position, and a lift mechanism in the safe portion, the lift mechanism being connected to the lift platform for moving the display housing between the security and display positions.

In a preferred embodiment, the locking mechanism includes a locking assembly including at least one latch finger adapted to be extended into and retracted from locking engagement within the enclosure when in the security position.

The lift mechanism includes an axially elongated threaded drive rod at opposite respective sides of the enclosure, the rods extending between the upper and lower ends of the safe portion and operably threadably connected to the lift platform, and a first drive motor for transmitting rotational torque substantially simultaneously to each of the drive rods. A second drive motor is provided for moving the at least one latch finger into and from locking and disengaged positions for locking the display housing in the security position.

A control system controls the lift and locking mechanisms. The control system includes a pair of limit switches that de-energize the first drive motor, a trip switch that energizes and de-energizes the second drive motor, and an actuator switch connected to the trip switch and said motors and positionable in either an "up" or a "down" position to selectively cause the display housing to move between the security position and secured entirely within the safe portion.

In operation, when the display housing is in the safe portion, the actuator switch operates in the "up" position to actuate the first and second drive motors to substantially simultaneously disengage the latch finger and free the display housing for vertical movement from the security position in the safe portion to the display position.

Movement of the actuator switch to the "down" position causes the display housing to move in a downward vertical direction from the display position into the safe portion whereupon the lower limit switch de-energizes the first drive motor and the trip switch energizes the second drive motor to cause the at least one latch finger to extend beneath the upper wall of the safe portion.

In a second aspect of the present invention, a security display case comprises: (a) an enclosure including a safe portion having upper and lower ends; (b) a first lock member disposed opposite the upper end of the safe portion; (c) a display portion extending upwardly from the upper end of the safe portion to a top end portion, said display portion having a pair of opaque sidewalls and an exterior front wall which is at least partially transparent; and (d) a display housing movable between a lowered or security position enclosed completely within the safe portion and raised to the display position disposed, at least in part, within the display portion.

The display housing includes a lift platform, for supporting and displaying articles when the display housing is disposed in the display portion, and a closure member spaced upwardly from the lift platform, the closure member being adapted to close and securely enclose the display housing in the safe portion when the display housing is lowered and in the security position, and a locking assembly mounted atop the closure member. The locking assembly is adapted to releasably lock the display housing relative to the enclosure when the display housing is disposed in the security position.

A lift mechanism is provided for moving the lift platform between the security and display positions, the lift mechanism being disposed in the safe portion and connected to the lift platform.

According to this preferred embodiment, each lock member includes at least one latch finger. Preferably, however, each lock member comprises a plurality of latch fingers, the latch fingers being adapted to extend and retract into and from retained relation when the display housing is in the safe portion.

Further, the lift mechanism includes a pair of axially elongated drive rods, a connecting arrangement for connecting the drive rods to the lift platform, a mounting arrangement for mounting opposite ends of the drive rods to the upper and lower ends of the safe portion for relative rotation thereto, and drive means for simultaneously rotating each of the drive rods whereby the interconnections between the rods and lift platform cause the lift platform to move axially vertically relative to the drive rods and to move vertically between a respective security and display position. The connecting arrangement includes a pair of drive blocks mounted on opposite respective sides of the lift platform, each drive block having a threaded through bore, and the drive rods are threaded and threadably connected to the through bore of a respective drive block, in situ rotation of the drive rods in one or the other direction causing the drive blocks to move the lift platform up or down depending on the sense of the rotation.

The drive means comprises a first drive motor and a second drive motor connected to the latch finger, such that energization of the motors operating in a manner whereby the first drive motor rotates the drive rods to move the lift platform vertically relative to the drive rods and between the security and display positions and the second drive motor moves the latch finger(s) into and from an associated latch keeper to releasably lock and unlock the display housing in the security position. In this arrangement, the first drive motor is disposed in the safe portion below the display housing and includes a pair of drive shafts, each drive shaft being drivingly connected to a respective drive rod. Preferably, each drive shaft terminates in a gear member that is drivingly connected to the lower end of a respective drive rod such that rotation of the drive shafts causes the gear members to rotate and substantially simultaneously transmit rotational torque to each of the drive rods.

Additionally, the security display case further comprises means for stabilizing the lift platform for parallel movement relative to the enclosure during movement of the lift platform between said security and display positions. According to this arrangement, there is provided first and second pairs of guide members with associated guide rods, the respective pairs of guide members being mounted on one and the other drive block with each guide member receiving a respective guide rod, the guide rods being within and extending between the upper and lower ends of the safe portion and constraining the lift platform to be oriented horizontally when moving between the security and display positions.

An actuator system is operably connected to the lift mechanism and lock assembly. The actuator system includes a key operated actuator switch, a first and second limit switch, and a trip switch, the switches and motors in electrical communication with one another with the switches being adapted to energize the motors wherein to disengage or engage the latch fingers and lock or free the display housing for movement between locked relation with the enclosure when in the safe portion. The trip switch is disposed in the locking assembly atop the display housing. The lower limit switch is proximate the lower end portion of the safe portion and the upper limit switch is proximate to the closure member of the display housing, the limit switches being adapted to be engaged by the display housing and turn off the first drive motor when the display housing reaches, respectively, the display position and is in the display housing and the security position and is in the safe portion.

The actuator switch is adapted to substantially simultaneously energize the motors and the trip switch wherein the trip switch causes the second drive motor to disengage the latch fingers and free the display housing for movement and the first drive motor to move the lift platform away from one limit switch and into engagement with the other limit switch wherein the limit switch thereat de-energizes the first drive motor and energizes the second drive motor whereat the trip switch causes the latch finger to lock the lift platform in place inside the enclosure.

In one preferred arrangement, the display housing includes a front and rear wall that are at least partially transparent in the display housing of the enclosure and extend between the sidewalls and each sidewall being opaque, the first and second lock members being disposed, at least in part, on one and the other sidewall proximate to one and the other of the security or display positions. In another preferred arrangement, the rear wall is opaque and mounted to the wall of a room into which the display case is to be utilized.

The present invention will be more clearly understood with reference to the accompanying drawing and to the following Detailed Description, in which like reference numerals refer to like parts and where:

BRIEF DESCRIPTION OF THE DRAWING

FIGS. 6A-6C are views of the locking assembly that is mountable atop the display housing of FIG. 1, wherein FIG. 6A is a side elevation view of the locking assembly and FIGS. 6B and 6C are perspective views looking down on the locking assembly with latch fingers thereof, respectively, shown retracted and extended;

DETAILED DESCRIPTION OF THE INVENTION

Figure 1:
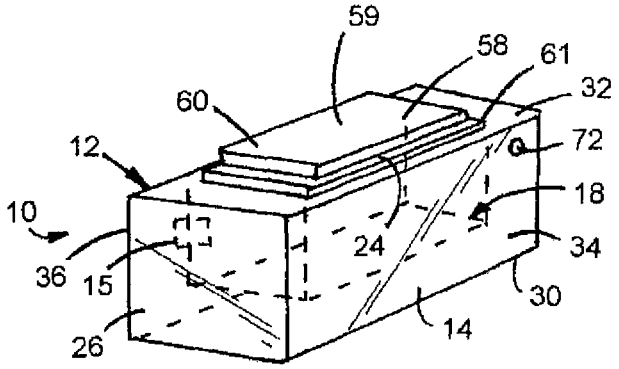
FIG. 1 is a perspective view of a security display case according to the present invention with a vertically movable display housing for supporting items to be displayed when lowered into a lower safe portion of the security case and secured therein, in part by a closure plate on a top of the display.
Figure 2:
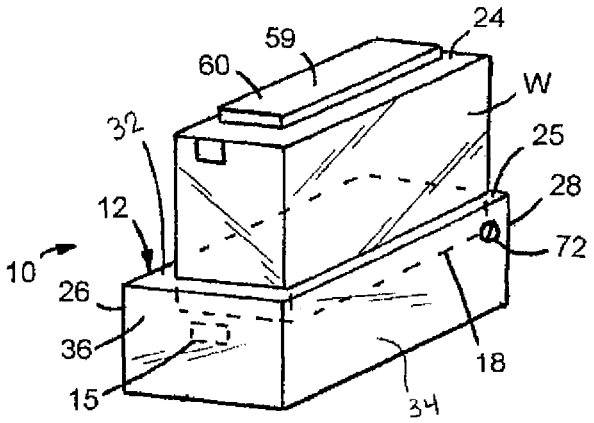
FIG. 2 is a perspective view of the display case of FIG. 1 showing the display housing when raised including a lift platform of the housing for displaying items thereon.
Figure 3:
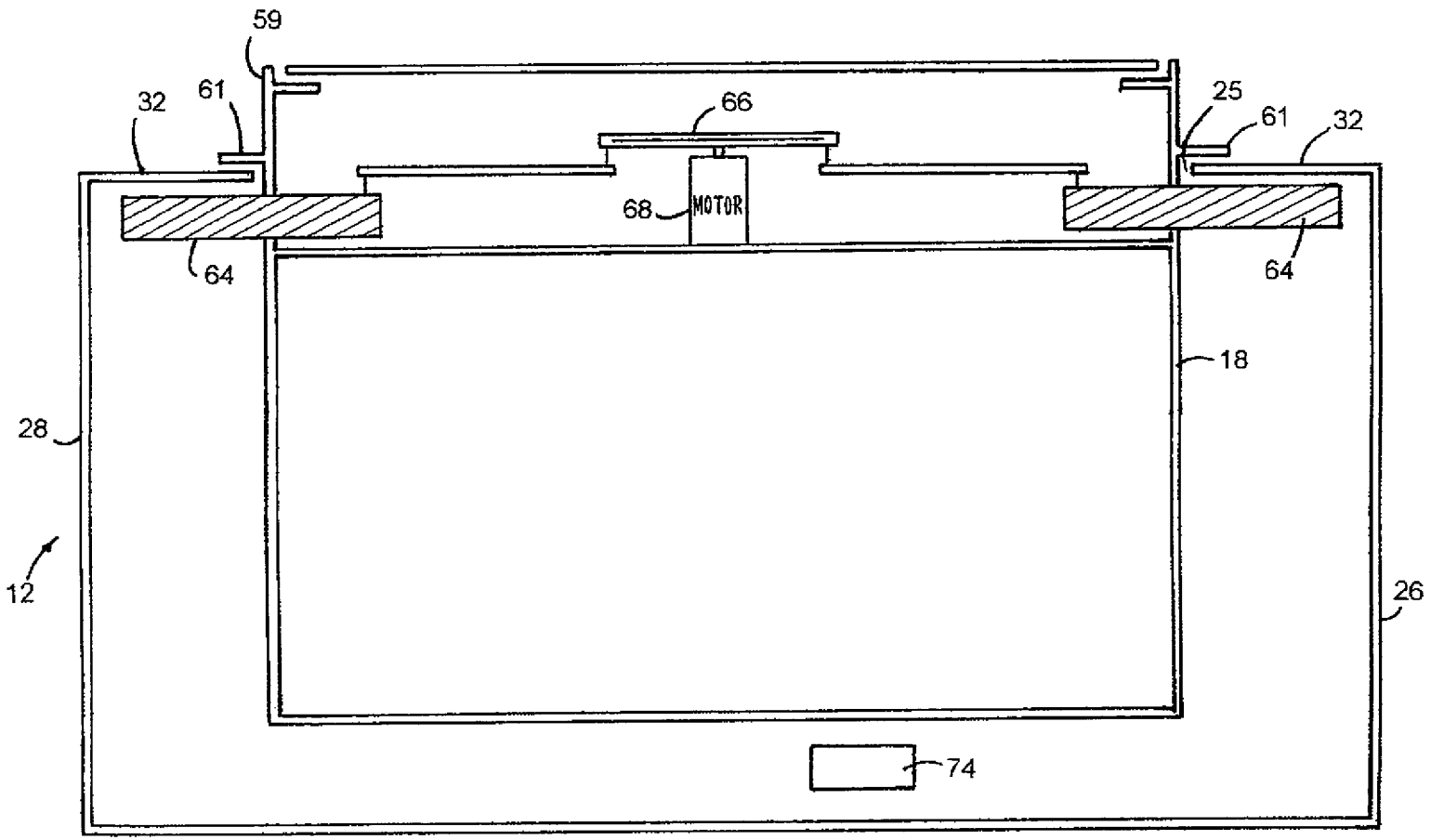
FIG. 3 is a partial cross-sectional view of the display case illustrating the interior of the display case when the display housing is lowered and the latch fingers all in the extending position.
Figure 3A:
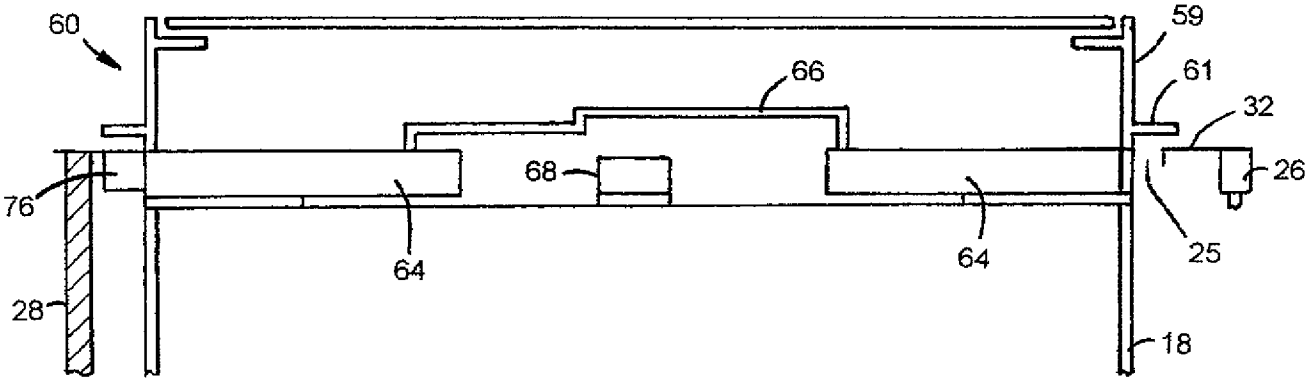
FIG. 3A is a view similar to FIG. 3, but showing the latch fingers in the retracted position.
Figure 4:
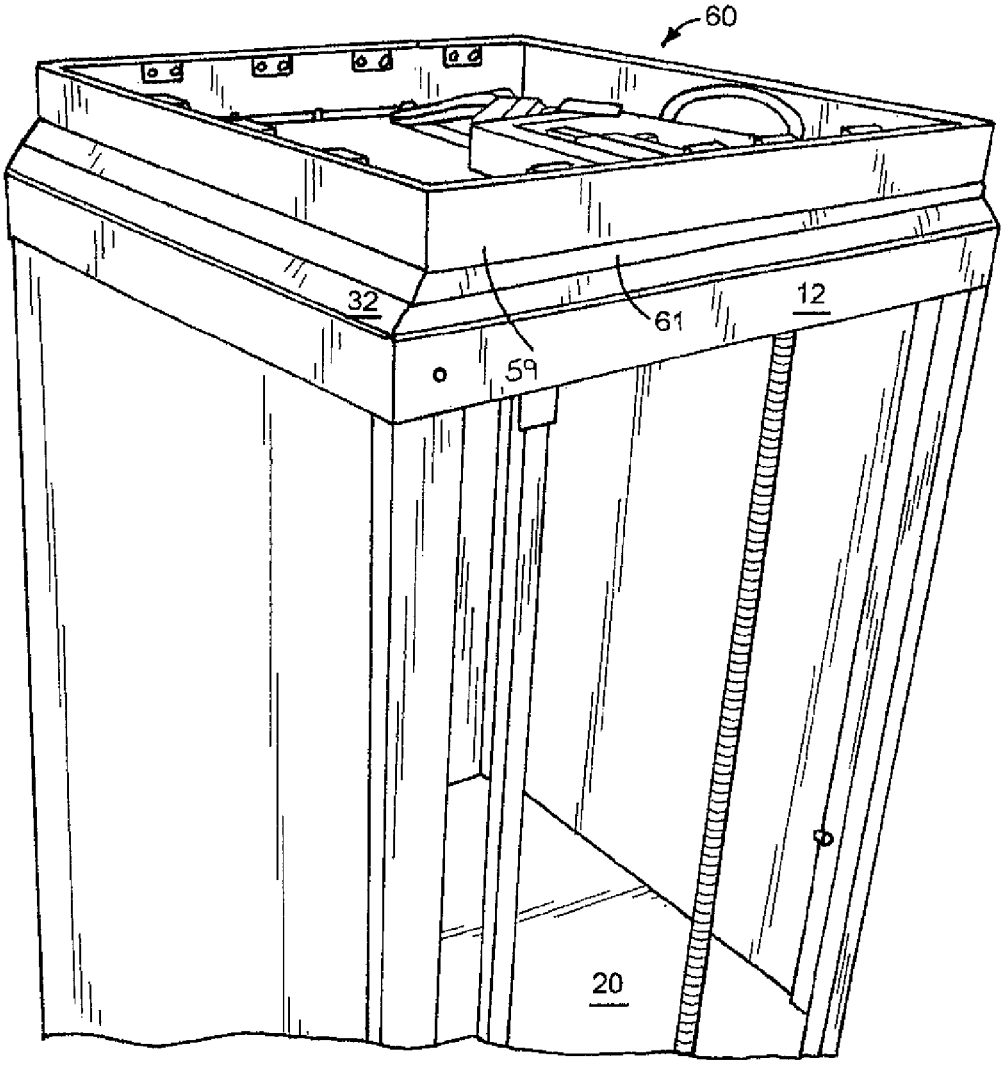
FIG. 4 is a partial view in perspective, showing the locking assembly seated atop the safe portion.

Turning now to the drawing, FIGS. 1-4 show a security display case 10 for easily moving items from a display position (FIG. 2) and into a safe for secured safe keeping (FIG. 1), and back from the safe into an extended upward position for viewing, when desired. The display housing 18 is raised and lowered without having to transfer the items into a remote safe for safekeeping after and before business hours.

The security display case 10 of the present invention includes a generally rectangular shaped enclosure 12 having a defined interior that forms a lower safe portion 14, having upper and lower ends, a first lock member disposed opposite the upper end of the safe portion, and the display housing 18 having a lower lift platform 20 and an upper end or closure member 24.

The enclosure 12 is formed by a pair of laterally spaced sidewalls 26 and 28, upper wall 32 and lower wall 30, and front and back walls 34 and 36, the walls being generally opaque and the upper wall 32, lower wall 30, front wall 34, and back wall 36 extending between sidewall 26 and sidewall 28 wherein to define an interior for receiving the display housing 18. The upper wall 32 has a central opening 25 through which the display housing 18 projects or extends and retracts.

As noted above, the display housing 18 is stowable within the safe portion 14 of the enclosure 12.

The display housing 18 is of such a size to essentially fill the interior of the safe portion 14 but move therewithin between a lowered or security position completely disposed within the safe portion 14 and securely sealed therewithin by a closure member 24.

Figure 5:
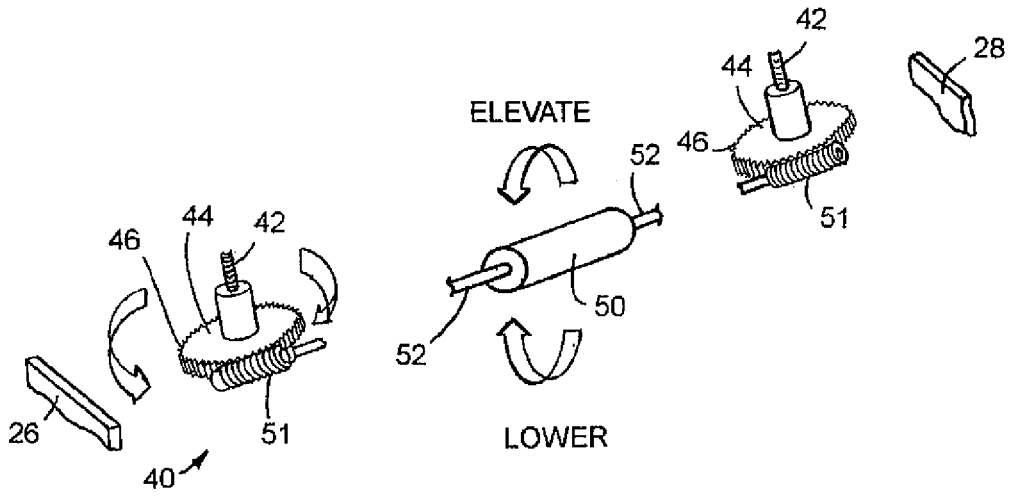
FIG. 5 is a partial view, in perspective, of a motor lift mechanism of the elevating mechanism and display housing partially raised.

As shown in FIG. 5, a lift mechanism 40 is provided for moving the lift platform 20 between the security and display positions, the lift mechanism 40 being disposed in the safe portion and drivingly connected to the lift platform 20. The lift mechanism 40 includes a pair of axially elongated, substantially parallel drive rods 42, a mounting arrangement for mounting opposite ends of the drive rods 42 to the upper and lower ends of the safe portion 14 for relative rotation thereto, a connecting arrangement for connecting the drive rods 42 to the lift platform 20, and drive means for substantially simultaneously rotating each of the drive rods 42 whereby the connecting arrangement between the rods 42 and the lift platform 20 cause the lift platform 20 to move axially relative to the drive rods 42 and to move vertically between a respective security and display position.

As shown in FIG. 5 the mounting arrangement includes a circular drive plate 44 for mounting each respective drive rod 42, each drive plate 44 being mounted for rotation on the lower wall of the safe portion 14 and providing the circumference of each respective plate 44 with gear teeth 46. The opposite ends of the drive rods 42, respectively, are journaled in the upper end of the safe portion 14 and fixedly secured to a respective drive plate 44 for rotation thereby.

The connecting arrangement includes a pair of drive blocks 48 mounted on opposite respective sides of the lift platform 20, each drive block 48 having a threaded through bore. The drive rods 42 are axially elongated, threaded, and threadably connected to the through bore of a respective drive block 48, wherein in situ rotation of the drive rods 42 in one or the other direction causes the drive blocks 48 to move the lift platform 20 up or down depending on the sense of the rotation.

The drive means comprises a first drive motor 50 drivingly connected to each of the drive rods 42, the first drive motor 50 being disposed in the safe portion 14 below the display housing 18 and includes a pair of drive shafts 52, the drive shafts 52 being drivingly connected to a respective drive rod 42. In a preferred embodiment, each drive shaft 52 terminates in a gear member 51 that is drivingly connected to the gear teeth 46 provided on the circumference of a respective drive plate 44. Energization of the first drive motor 50 causes the drive shafts 52 thereof to substantially simultaneously rotate the gear members 51 and transmit rotational torque to rotate both of the drive plates 44 and associated drive rods 42. Rotations of the drive rods 42 causes the lift platform 20 to raise or lower, depending on the sense of rotation of the drive rods 42.

Figure 8:
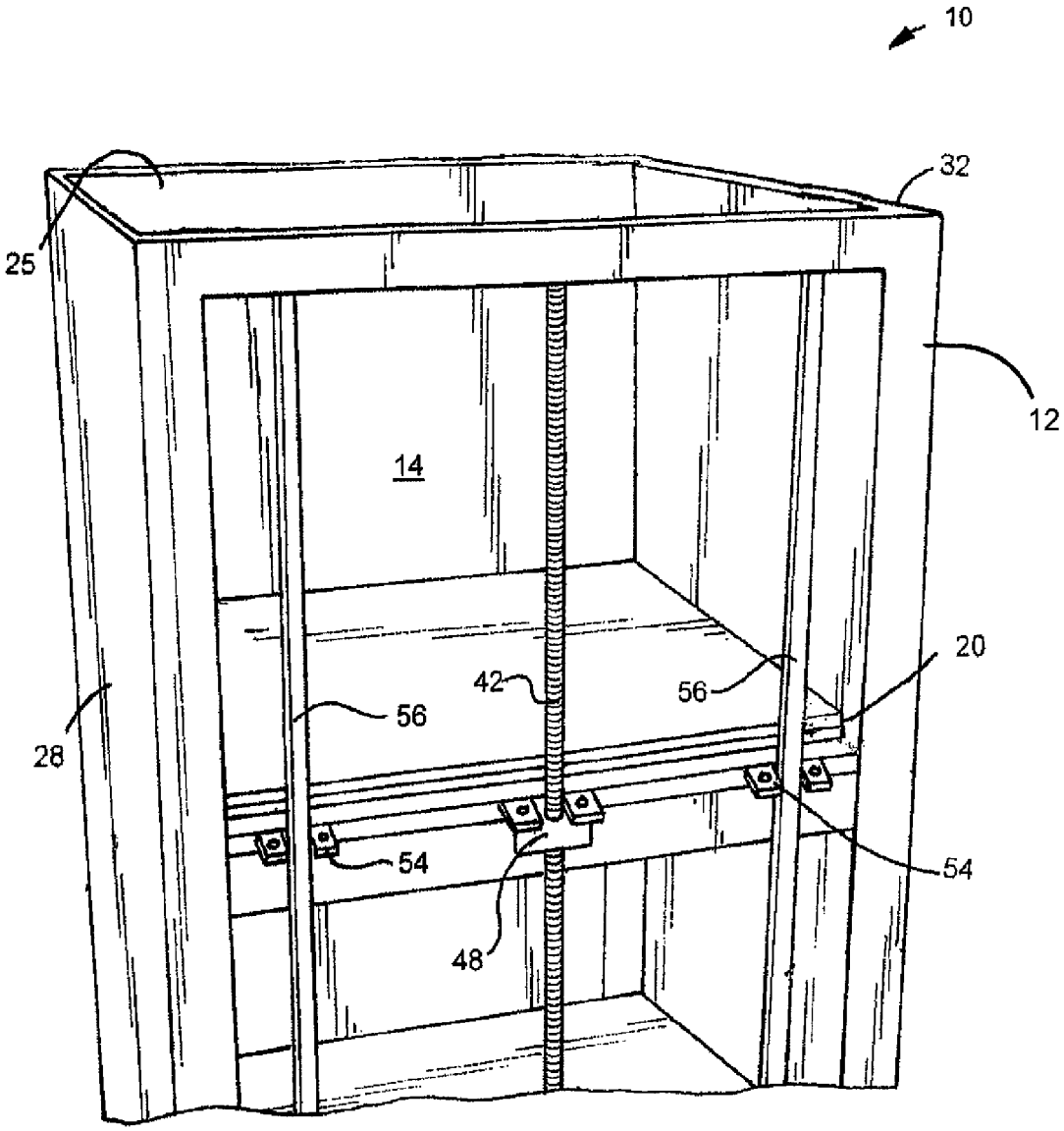
FIG. 8 is a perspective view, with components eliminated showing the display assembly partially raised.

Additionally, and as shown in FIG. 8, the security display case 10 further comprises an arrangement for stabilizing the lift platform 20 for horizontal movement relative to the enclosure 12 during movement of the of the lift platform 20 between the lower security and raised display positions. According to a preferred arrangement, there is provided a first and second pair of guide members 54 with associated guide rods 56, the respective pairs of guide members 54 being mounted on one and the other drive block 48 with each guide member 54 receiving a respective guide rod 56, the guide rods 56 extending between the upper and lower ends of the safe portion 14 and constraining the lift platform 20 to remain oriented horizontally when moving between the security and display positions.

The display case 10 includes a locking mechanism 58 for locking the closure member 24 of the display housing 18 to the enclosure 12 when the display housing 18 is in the security position.

In a preferred embodiment, the locking mechanism 58 comprises a locking assembly 60 atop the display housing 18.

Figure 6A:
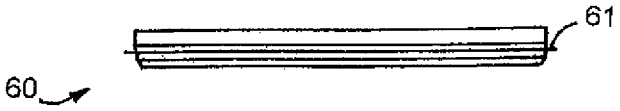
Figure 6B:
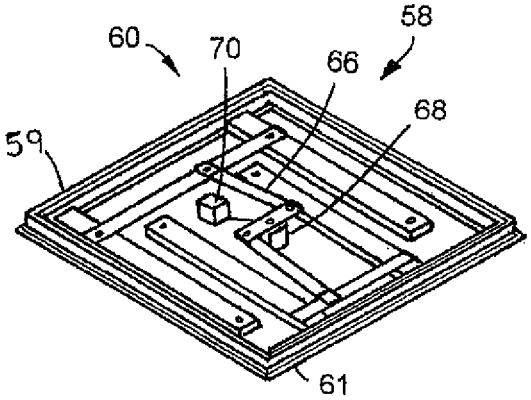
Figure 6C:
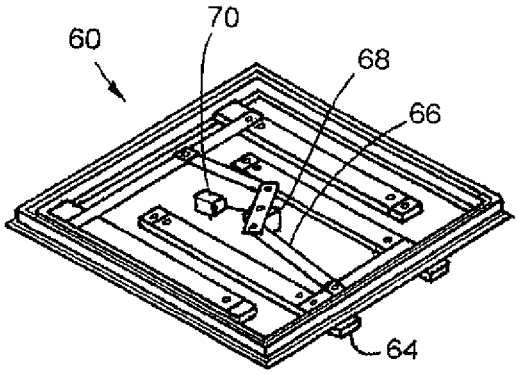

Turning to FIGS. 6A-6C, a preferred embodiment of the locking assembly 60 is shown. The locking assembly 60 includes first and second pairs of latch fingers 64 and a linkage system 66, each respective pair of latch fingers 64 being operably connected to the linkage system 66 and adapted to be slidably extended and retracted from locking engagement with respective pairs of latch keepers 15 and selectively lock the display housing 18 to the enclosure 12.

Figure 7:
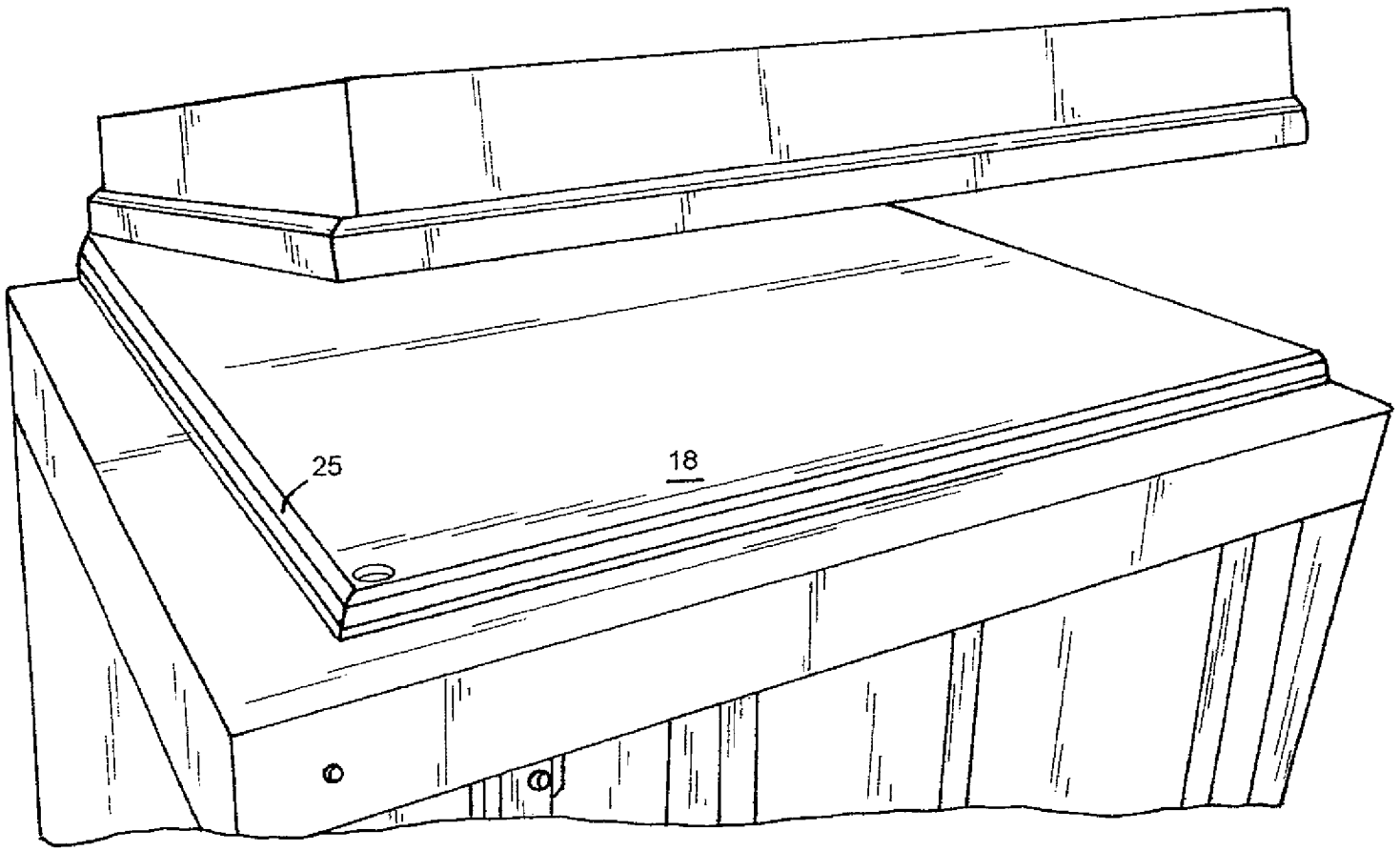
FIG. 7 is a view showing the seating of the locking assembly atop the upper wall of the display housing.

As shown in the drawing, the locking assembly 60 is disposed within a housing 59. The housing 59 has a lateral, peripheral flange 61. The latch fingers 64 are positioned below the flange 61 a sufficient distance such that, in the security position, the flange 61 lies below the upper wall 32 (FIG. 7) of the safe portion of the enclosure 12.

At least one second drive motor 68, but preferably only one second drive motor 68, and a trip switch 70 are disposed in the locking assembly 60, the second drive motor 68 in operable driving relation to the linkage system 66 and in electrical circuit relation to the trip switch 70. Energization of the second drive motor 68 by a signal from the trip switch 70 operates to cause the linkage system 66 to extend or retract the latch fingers 64 to lock or free the display housing 18 for movement by the first drive motor 50 relative to the safe portion 14.

A control system controls the locking mechanism 58 and lift mechanism 40. The control system includes an actuator switch 72, a lower limit switch 74, and an upper limit switch 76, the actuator switch 72 being in electrical circuit relation with the motors 50 and 68, limit switches 74 and 76, and trip switch 70.

The actuator switch 72 is externally operated by a key and is initially in a "neutral position," but selectively positionable to either an "up" or a "down" position to energize and cause the first drive motor 50 to rotate the drive shafts 52 and transmit torque to the drive rods 42 whereby to move the display housing 18 up from the security position or down from the display position.

The limit switches 74 and 76 are engaged by movement of the display housing 18. Engagement of a limit switch 74 or 76 by the display housing 18 will cause the first drive motor 50 to de-energize and position the display housing 18 in one and the other security and display positions.

Assume the display housing 18 is initially in the security position and locked in the safe portion 14 by the latch fingers 64. Movement of the actuator switch 72 to the "up" position will energize both drive motors 50 and 68 and cause a signal to be sent to the trip switch 70 and motors 50 and 68 whereby the second drive motor 68 will cause the latch fingers 64 to retract from their position below the upper wall 32 and free the display housing 18. The first drive motor 50 will effect movement of the display housing 18 upward and away from the lower limit switch 74. Ultimately, the display housing 18 will engage the upper limit switch 76 whereupon a signal will be sent to de-energize the first drive motor 50 and position the display housing 18.

An appropriate controller (not shown) ensures that the second drive motor 68 will not burn out when the linkage system 66 has moved the latch fingers 64 into and from locked relation.

The above process is reversed when the user wishes to place the display housing 18 in locked relation in the safe portion 14. The actuator key is turned to "down" whereupon electrical signals are sent to the motors 50 and 68 and trip switch 70 whereon the display housing 14 moves into locked relation with the latch fingers 64 extended beneath the upper wall 32 with the flange 61 seating atop the upper wall 32 while precluding access into the safe portion 14.

In this embodiment, the display case 10 is either fixedly mounted to the floor or freestanding and able to be moved.

The display case 10 may be mounted to the floor via a plurality of bolts or the like extending through the lower wall 30 and the floor. Alternatively, the display case 10 may be mounted to the floor via a plurality of L-shaped brackets or the like bolted to the side walls 26, 28, front wall 34, back wall 36, or combination thereof wherein the plurality of brackets is similarly bolted to the floor and the display case 10 is secured thereto.

While the display case 10 may be abutted against a wall, when the display case 10 is spaced away from a wall, thus allowing a person to walk around and view the entirety of the display case 10, it is preferred that each wall of the display housing 18 is at least partially transparent.

Figure 9:
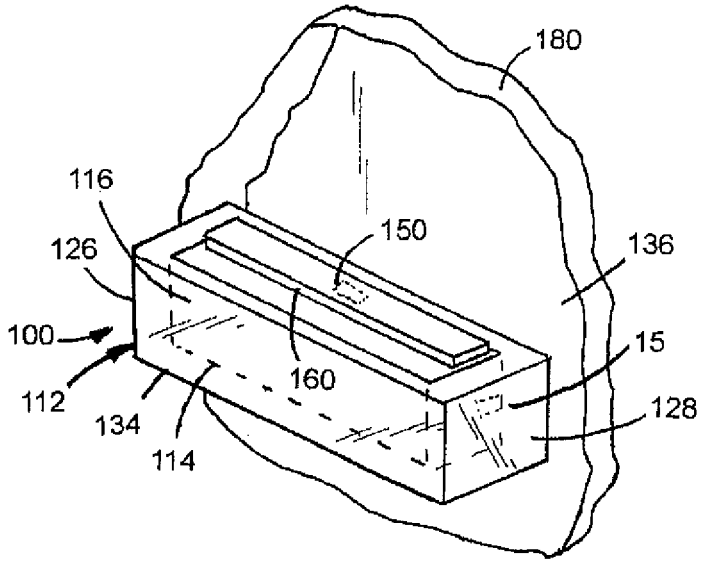
FIG. 9 is a partially perspective view of an alternate embodiment of a display case according to this invention.

Further, referring to FIG. 9, a perspective view of an alternate embodiment of a display case according to this invention is denoted at 100, the display case 100 being wall mounted and above the floor of a room, the display case 100 being similar to FIG. 1 but including an alternate embodiment of a locking mechanism and latching fingers thereof.

According to this aspect of the present invention, the security display case 100 comprises elements that are substantially the same in function as described with respect to the display case 10 hereinbove. In general, the display case 100 comprises an enclosure 112 formed by a pair of sidewalls 126 and 128, a front wall 134, a back wall 136, the walls cooperating, at least in part, to form a safe portion 114 and a display housing 116, the front wall 134 of the display housing 116 is at least partially transparent to provide a viewing window W. The lift arrangement for moving the display housing 116 from the safe portion 114 and into the display mode includes, a locking assembly 160 atop the display housing 116, the locking assembly 160 operable with the lock members to releasably lock the display housing 116 in the safe portion 114, and an actuator system electrically connected to the lower and upper limit switches, a trip switch 170 atop the locking assembly 160, a first drive motor for lifting the display housing 116, and a second drive motor 168 for driving latch fingers into and from locked engagement with the display housing 116 as described below.

According to this embodiment, the back wall 136 is adapted to mount the enclosure 112 in a room wall 180 in vertically spaced relation to the floor of the room.

Further, referring to FIGS. 10A-10D, the locking assembly 160 is generally rectangular and includes an upper housing 178 and a pair of long sides 178*a* and 178*b*, a pair of short sides 178*c* and 178*d*, a closure member 124 that extends outwardly from the sides 178*a* and 178*b* of the upper housing 178, a trip switch 170, a pair of laterally spaced first latch fingers 164*a* associated with the front side 178*a*, a pair of laterally spaced second latch fingers 164*b* associated with the rear side 178*b*, a third latch finger 164*c* associated with side 178*c*, a fourth latch finger 164*d* associated with side 178*d*, and a linkage system 166 connected to the latch fingers and second drive motor 168.

Figure 10A:
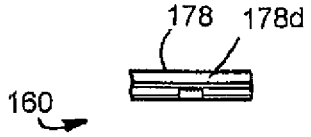
FIGS. 10A-10D are front and side elevations views (FIGS. 10A and 10B) and perspective views (FIGS. 10C and 10D) of the locking assembly connected atop the display housing of FIG. 9, the perspective views showing the locking assembly when the latching fingers thereof are retracted (FIG. 10C) and extended (FIG. 10D).
Figure 10B:
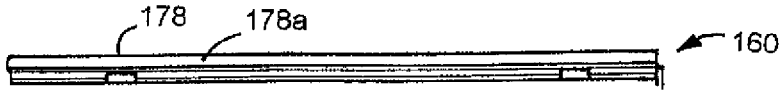
Figure 10C:
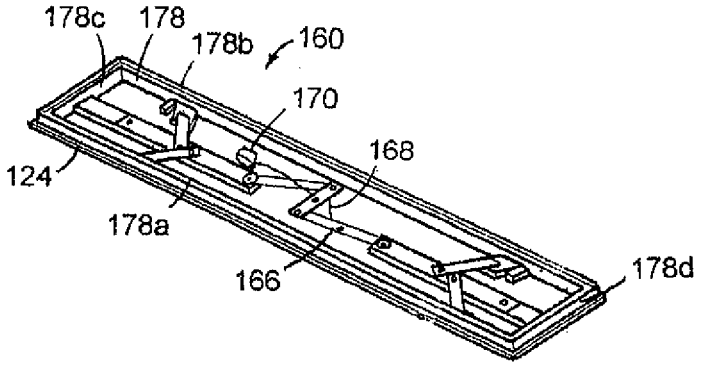

In FIG. 10C, the latch fingers 164*a*, 164*b*, 164*c*, and 164*d* are in a retracted position.

Figure 10D:
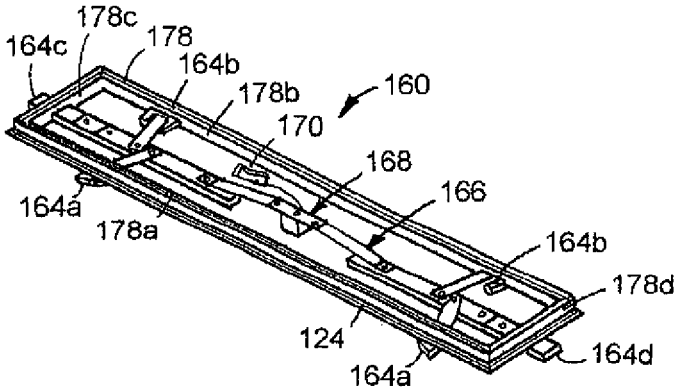

In FIG. 10D, as a result of a signal from the trip switch 170 to the second drive motor 168, the linkage system 166 has moved in a manner to force the latch fingers 164*a*, 164*b*, 164*c*, and 164*d* outwardly for engagement beneath an upper wall of the safe portion 114 in the same manner discussed above to lock the display housing 116 in the security position.

It should be noted that in either embodiment the safe portion is preferably formed of steel or other hardened metal which, for decorative purposes, may be provided with a cladding such as wood or the like which is fastened thereto with any suitable means.

Similarly, the base or bottom wall of the display housing is secured to the left platform with suitable fasteners such as screws, bolts or the like.

Also, regardless of which locking assembly is deployed, it is secured to the upper wall of the display housing with suitable fasteners and the cover therefor, is also, similarly mounted.

Having thus described the invention, what is claimed is:

1. A security display case comprising:

(a) an enclosure comprising a pair of laterally spaced sidewalls, an upper wall, a lower wall, a front wall and a back wall, the upper wall, lower wall, front wall, and back wall extending between the sidewalls to define an interior, the interior defining a lower safe portion and having a central opening formed in the upper wall permitting access to the interior;

(b) a display housing moveable into and out of the safe portion of the enclosure through the central opening, the display housing having a lower lift platform, a closure member opposite the lower lift platform, two sidewalls interconnecting the lower lift platform and the closure member, and a front and back wall interconnecting the two side panels, at least one of the walls at least partially transparent;

(c) a lift mechanism, the lift mechanism being disposed in the safe portion and drivingly connected to the lift platform, the lift mechanism comprising a pair of axially elongated drive rods, a mounting arrangement for mounting opposite ends of the drive rods to the lower and upper walls of the enclosure, a connecting arrangement for connecting the drive rods to the lift platform, drive means for substantially simultaneously rotating each of the drive rods whereby the connecting arrangement causes the lift platform to move axially relative to the drive rods and to move vertically between a security and a display position, and a first drive motor, the first drive motor controlling the drive means;

(d) a locking mechanism, the locking mechanism being mounted atop the closure member, the locking mechanism comprises at least one latch finger and a second drive motor, the at least one latch finger adapted to be extended into and retracted out of at least one wall of the enclosure, the second drive motor moving the at least one latch finger;

(e) a control system, the control system in communication with the first drive motor and the second drive motor.

2. The security display case of claim 1 wherein the mounting arrangement comprises: a drive plate for mounting each respective drive rod, each drive plate being mounted for rotation on the lower wall of the enclosure, a plurality of gear teeth disposed on the circumference of each drive plate, the opposite ends of the drive rods being journaled in the upper wall of the enclosure.

3. The security display case of claim 1 wherein the connecting arrangement comprises: a pair of drive blocks mounted on opposite respective sides of the lift platform, each drive block having a threaded through bore, the drive rods being threadably connected to the through bore of a respective drive block.

4. The security display case of claim 3 wherein the connecting arrangement further comprises: means for stabilizing the lift platform for parallel movement, the means for stabilizing comprises a first and a second pair of guide members with associated guide rods extending between the upper and lower walls of the enclosure, the guide members constraining the lift platform to remain oriented horizontally.

5. The security display case of claim 3 wherein the drive means comprises: a pair of drive shafts connected to opposing ends of the first drive motor, each drive shaft being drivingly connected to a respective drive rod, each drive shaft terminates at a gear member being drivingly connected to the gear teeth on the respective drive plate, the first drive motor causes the drive shafts to substantially simultaneously rotate the gear members and transmit rotational torque to rotate the drive plates and associated drive rods.

6. The security display case of claim 1 wherein the locking mechanism further comprises: first and second pair of latch fingers and a linkage system, each respective pair of latch fingers being operably connected to the linkage system and adapted to be slidably extended into and retracted out of the front, back, and sidewalls of the enclosure.

7. The security display case of claim 1 wherein the control system comprises: a lower limit switch disposed proximate the lower wall of the enclosure, an upper limit switch disposed proximate the upper wall of the enclosure, a trip switch in communication with the second drive motor, and an actuator switch in communication with the trip switch and first and second drive motors, the lower and upper limit switches de-energizes the first drive motor when the lift platform comes into contact with the lower wall of the enclosure, and the actuator switch energizes the first drive motor, second drive motor, and trip switch, the trip switch causes the second drive motor to disengage the latch fingers.

8. The security display case of claim 7 wherein the actuator switch is a key actuated switch accessible outside of the enclosure.

* * * * *